US009578432B1

(12) United States Patent
Abdollahzadeh Milani et al.

(10) Patent No.: US 9,578,432 B1
(45) Date of Patent: Feb. 21, 2017

(54) METRIC AND TOOL TO EVALUATE SECONDARY PATH DESIGN IN ADAPTIVE NOISE CANCELLATION SYSTEMS

(71) Applicant: Cirrus Logic, Inc., Austin, TX (US)

(72) Inventors: Ali Abdollahzadeh Milani, Austin, TX (US); John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 382 days.

(21) Appl. No.: 14/259,806

(22) Filed: Apr. 23, 2014

Related U.S. Application Data

(60) Provisional application No. 61/815,281, filed on Apr. 24, 2013.

(51) Int. Cl.
*H04R 3/02* (2006.01)
*H04R 29/00* (2006.01)
*H04R 3/00* (2006.01)

(52) U.S. Cl.
CPC ..... *H04R 29/001* (2013.01); *H04R 3/002* (2013.01)

(58) Field of Classification Search
CPC ..... G10L 21/0208; G10L 21/0232; G10K 2210/3026; G10K 2210/3027
USPC ..... 381/71.1, 71.8, 71.11, 94.1, 93, 95, 96,381/94.7
See application file for complete search history.

(56) References Cited

U.S. PATENT DOCUMENTS 4,020,567 A 5/1977 Webster
4,926,464 A 5/1990 Schley-May
4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
(Continued)

FOREIGN PATENT DOCUMENTS

CN 101552939 A 10/2009
DE 102011013343 A1 9/2012
(Continued)

OTHER PUBLICATIONS

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
(Continued)

*Primary Examiner* — George Monikang
(74) *Attorney, Agent, or Firm* — Robert P. Bell; Steven Lin

(57) ABSTRACT

The present invention provides a system and method encompassing a new metric and MATLAB tool box that phone makers may use to improve the design of the secondary path, in order to improve ANC performance. The metric measures how invertible the secondary path is and then evaluates ANC performance at a worst case scenario where P(z)=1 and W(z) becomes a complete predictor. The invention can be easily extended to a multi-channel ANC system.

22 Claims, 13 Drawing Sheets

(56) References Cited

U.S. PATENT DOCUMENTS 5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell
5,548,681 A 8/1996 Gleaves et al.
5,550,925 A 8/1996 Hori et al.
5,559,893 A 9/1996 Krokstad et al.
5,586,190 A 12/1996 Trantow et al.
5,633,795 A 5/1997 Popovich
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,185,300 B1 2/2001 Romesburg
6,219,427 B1 4/2001 Kates et al.
6,278,786 B1 8/2001 McIntosh
6,282,176 B1 8/2001 Hemkumar
6,304,179 B1 10/2001 Lotito et al.
6,317,501 B1 11/2001 Matsuo
6,418,228 B1 7/2002 Terai et al.
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,850,617 B1 2/2005 Weigand
6,940,982 B1 9/2005 Watkins
7,016,504 B1 3/2006 Shennib
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,441,173 B2 10/2008 Restrepo et al.
7,466,838 B1 12/2008 Moseley
7,680,456 B2 3/2010 Muhammad et al.
7,742,746 B2 6/2010 Xiang et al.
7,742,790 B2 6/2010 Konchitsky et al.
7,817,808 B2 10/2010 Konchitsky et al.
7,885,417 B2 2/2011 Christoph
7,953,231 B2 5/2011 Ishida
8,019,050 B2 9/2011 Mactavish et al.
8,085,966 B2 12/2011 Amsel
8,107,637 B2 1/2012 Asada et al.
8,165,312 B2 4/2012 Clemow
8,165,313 B2 4/2012 Carreras
D666,169 S 8/2012 Tucker et al.
8,249,262 B2 8/2012 Chua et al.
8,251,903 B2 8/2012 LeBoeuf et al.
8,254,589 B2 8/2012 Mitsuhata
8,290,537 B2 10/2012 Lee et al.
8,325,934 B2 12/2012 Kuo
8,331,604 B2 12/2012 Saito et al.
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,532,310 B2 9/2013 Gauger, Jr. et al.
8,559,661 B2 10/2013 Tanghe
8,600,085 B2 12/2013 Chen et al.
8,775,172 B2 7/2014 Konchitsky et al.
8,804,974 B1 8/2014 Melanson
8,831,239 B2 9/2014 Bakalos
8,842,848 B2 9/2014 Donaldson et al.
8,848,936 B2 9/2014 Kwatra et al.
8,855,330 B2 10/2014 Taenzer
8,907,829 B1 12/2014 Naderi
8,908,877 B2 12/2014 Abollahzadeh Milani et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,066,176 B2 6/2015 Hendrix et al.
9,071,724 B2 6/2015 Do et al.
9,076,431 B2 7/2015 Kamath et al.
9,082,391 B2 7/2015 Yermeche et al.
9,094,744 B1 7/2015 Le et al.
9,106,989 B2 8/2015 Li et al.
9,107,010 B2 8/2015 Abdollahzadeh Milani et al.
9,129,586 B2 9/2015 Bajic et al.
9,230,532 B1 1/2016 Lu et al.
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1 6/2004 Woods
2004/0165736 A1 8/2004 Heatherington et al.
2004/0167777 A1 8/2004 Heatherington et al.
2004/0196992 A1 10/2004 Ryan
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0013408 A1 1/2006 Lee
2006/0018460 A1 1/2006 McCree
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2006/0159282 A1 7/2006 Borsch
2006/0161428 A1 7/2006 Fouret
2006/0251266 A1 11/2006 Saunders et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph

(56) References Cited

U.S. PATENT DOCUMENTS

2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2008/0269926 A1 10/2008 Xiang et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0002891 A1 1/2010 Shiraishi et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Wessling et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0195838 A1 8/2010 Bright
2010/0195844 A1 8/2010 Christoph et al.
2010/0226210 A1 9/2010 Kordis et al.
2010/0239126 A1 9/2010 Grafenberg et al.
2010/0246855 A1 9/2010 Chen
2010/0260345 A1 10/2010 Shridhar et al.
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 De Brunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0026724 A1 2/2011 Doclo
2011/0091047 A1 4/2011 Konchitsky et al.
2011/0096933 A1 4/2011 Eastty
2011/0099010 A1* 4/2011 Zhang ..... G10L 21/0272
704/233
2011/0106533 A1 5/2011 Yu
2011/0116654 A1 5/2011 Chan et al.
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300955 A1 11/2012 Iseki et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0195282 A1 8/2013 Ohita et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson et al.
2013/0315403 A1 11/2013 Samuelsson
2013/0343556 A1 12/2013 Bright
2013/0343571 A1 12/2013 Rayala et al.
2014/0016803 A1 1/2014 Puskarich
2014/0036127 A1 2/2014 Pong et al.
2014/0044275 A1 2/2014 Goldstein et al.
2014/0050332 A1 2/2014 Nielsen et al.
2014/0072134 A1 3/2014 Po et al.
2014/0086425 A1 3/2014 Jensen et al.
2014/0126735 A1 5/2014 Gauger, Jr.
2014/0146976 A1 5/2014 Rundle
2014/0169579 A1 6/2014 Azmi
2014/0177851 A1 6/2014 Kitazawa et al.
2014/0177890 A1 6/2014 Hojland et al.
2014/0211953 A1 7/2014 Alderson et al.
2014/0270222 A1 9/2014 Hendrix et al.
2014/0270224 A1 9/2014 Zhou et al.
2014/0294182 A1 10/2014 Axelsson et al.
2014/0307887 A1 10/2014 Alderson
2014/0307888 A1 10/2014 Alderson et al.
2014/0307890 A1 10/2014 Zhou et al.
2014/0314244 A1 10/2014 Yong
2014/0314246 A1 10/2014 Hellman
2014/0314247 A1 10/2014 Zhang
2014/0341388 A1 11/2014 Goldstein
2014/0369517 A1 12/2014 Zhou et al.
2015/0010403 A1 1/2015 Wilson et al.
2015/0092953 A1 4/2015 Abdollahzadeh Milani et al.
2015/0161980 A1 6/2015 Alderson et al.
2015/0161981 A1 6/2015 Kwatra
2015/0163592 A1 6/2015 Alderson
2015/0189434 A1 7/2015 Hendrix et al.

(56) References Cited

U.S. PATENT DOCUMENTS

| | | | |
|---|---|---|---|
| 2015/0256660 | A1 | 9/2015 | Kaller et al. |
| 2015/0256953 | A1 | 9/2015 | Kwatra et al. |
| 2015/0269926 | A1 | 9/2015 | Alderson et al. |
| 2015/0296296 | A1 | 10/2015 | Lu et al. |
| 2015/0365761 | A1 | 12/2015 | Alderson et al. |

FOREIGN PATENT DOCUMENTS

| | | | |
|---|---|---|---|
| EP | 0412902 | | 2/1991 |
| EP | 0756407 | | 1/1997 |
| EP | 0898266 | | 2/1999 |
| EP | 1691577 | | 11/2005 |
| EP | 1880699 | A2 | 1/2008 |
| EP | 1947642 | A1 | 7/2008 |
| EP | 2133866 | A1 | 12/2009 |
| EP | 2237573 | | 10/2010 |
| EP | 2216774 | A1 | 8/2011 |
| EP | 2395500 | A1 | 12/2011 |
| EP | 2395501 | A1 | 12/2011 |
| EP | 2551845 | | 1/2013 |
| GB | 2401744 | A | 11/2004 |
| GB | 2346657 | | 10/2007 |
| GB | 2455821 | A | 6/2009 |
| GB | 2455824 | A | 6/2009 |
| GB | 2455828 | A1 | 6/2009 |
| GB | 2484722 | A | 4/2012 |
| GB | 1512832.5 | | 1/2016 |
| GB | 1519000.2 | | 4/2016 |
| JP | 06006246 | | 1/1994 |
| JP | H06-186985 | A | 7/1994 |
| JP | H06232755 | | 8/1994 |
| JP | 07098592 | | 4/1995 |
| JP | 07104769 | | 4/1995 |
| JP | 07240989 | | 9/1995 |
| JP | 07325588 | | 12/1995 |
| JP | H111305783 | | 11/1999 |
| JP | 2000089770 | | 3/2000 |
| JP | 2002010355 | | 1/2002 |
| JP | 2004007107 | | 1/2004 |
| JP | 2006217542 | | 8/2006 |
| JP | 2007060644 | | 3/2007 |
| JP | 2008015046 | | 1/2008 |
| JP | 2010277025 | | 12/2010 |
| JP | 2011061449 | | 3/2011 |
| WO | 9113429 | | 9/1991 |
| WO | 9911045 | | 3/1999 |
| WO | 03015074 | A2 | 2/2003 |
| WO | WO03015275 | A1 | 2/2003 |
| WO | WO2004009007 | A1 | 1/2004 |
| WO | WO2004017303 | A1 | 2/2004 |
| WO | 2006125061 | | 11/2006 |
| WO | 2006128768 | | 12/2006 |
| WO | 2007007916 | A1 | 1/2007 |
| WO | 2007011337 | | 1/2007 |
| WO | 2007110807 | | 10/2007 |
| WO | 2007113487 | A1 | 11/2007 |
| WO | 2009041012 | | 4/2009 |
| WO | 2009110087 | | 9/2009 |
| WO | 2010117714 | A1 | 10/2010 |
| WO | 2010131154 | | 11/2010 |
| WO | 2012107561 | | 8/2012 |
| WO | 2012134874 | A1 | 10/2012 |
| WO | 2013106370 | | 7/2013 |
| WO | 2014172005 | | 10/2014 |
| WO | 2014172021 | | 10/2014 |
| WO | 2015191691 | | 10/2014 |
| WO | 2015038255 | | 3/2015 |
| WO | 2015088639 | | 6/2015 |
| WO | 2015088651 | | 6/2015 |
| WO | 2015088653 | | 6/2015 |
| WO | 2015134225 | | 9/2015 |
| WO | 2015191691 | | 12/2015 |
| WO | PCTUS2015066260 | | 4/2016 |
| WO | 2016100602 | A1 | 6/2016 |

OTHER PUBLICATIONS

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (INDICON) 2011 Annual IEEE, IEEE, Dec. 15, 2011.

Rangachari et al., "A noise-estimation algorithm for highly non-stationary environments" Speech Communication, Elsevier Science Publishers, vol. 48, No. 2, Feb. 1, 2006.

International Search Report and Written Opinion of the International Searching Authority, International Patent Application No. PCT/US2014/017343, mailed Aug. 8, 2014, 22 pages.

International Search Report and Written Opinion of the International Searching Authority, International Patent Application No. PCT/US2014/018027, mailed Sep. 4, 2014, 14 pages.

International Search Report and Written Opinion of the International Searching Authority, International Patent Application No. PCT/US2014/017374, mailed Sep. 8, 2014, 13 pages.

International Search Report and Written Opinion of the International Searching Authority, International Patent Application No. PCT/US2014/019395, mailed Sep. 9, 2014, 14 pages.

International Search Report and Written Opinion of the International Searching Authority, International Patent Application No. PCT/US2014/019469, mailed Sep. 12, 2014, 13 pages.

Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.

Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.

Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.

Widrow, B. et al., Adaptive Noise Cancelling; Principles and Applications, Proceedings of the IEEE, IEEE, New York, NY, U.S. vol. 63, No. 13, Dec. 1975, pp. 1692-1716.

Morgan, Dennis R. et al., A Delayless Subband Adaptive Filter Architecture, IEEE Transactions on Signal Processing, IEEE Service Center, New York, New York. US, vol. 43, No. 8, Aug. 1995, pp. 1819-1829.

International Search Report and Written Opinion of the International Searching Authority, International Patent Application No. PCT/US2014/040999, mailed Oct. 18, 2014, 12 pages.

International Search Report and Written Opinion of the International Searching Authority, International Patent Application No. PCT/US2034/049407, mailed Jun. 18, 2914, 13 pages.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

(56) References Cited

OTHER PUBLICATIONS

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt 1, Ottawa, Ontario, Canada.
Cohen, et al., "Noise Estimation by Minima Controlled Recursive Averaging for Robust Speech Enhancement", IEEE Signal Processing Letters, vol. 9, No. 1, Jan. 2002.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Lopez-Caudana, Edgar Omar, "Active Noise Cancellation: The Unwanted Signal and the Hybrid Solution", Adaptive Filtering Application, Dr. Lino Garcia (Ed.), Jul. 2011, pp. 49-84, ISBN: 978-953-307-306-4, InTech.
Kuo, et al., "Residual noise shaping technique for active noise control systems", J. Acoust. Soc. Am. 95 (3), Mar. 1994, pp. 1665-1668.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", Plos One, Nov. 2012, pp. 1-7, vol. 7, Issue 11, e49370, Ontario, Canada.
Parkins, et al., "Narrowband and broadband active control in an enclosure using the acoustic energy density", J. Acoust. Soc. Am. Jul. 2000, pp. 192-203, vol. 108, issue 1, US.
Rafaely, Boaz, "Active Noise Reducing Headset—an Overview", The 2001 International Congress and Exhibition on Voise Control Engineering, Aug. 27-30, 2001, 10 pages (pp. 1-10 in pdf), The Netherlands.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, vol. 120, No. 4, New York, NY.

* cited by examiner

METRIC AND TOOL TO EVALUATE SECONDARY PATH DESIGN IN ADAPTIVE NOISE CANCELLATION SYSTEMS

CROSS-REFERENCE TO RELATED APPLICATIONS

The present application claims priority from Provisional U.S. Patent Application No. 61/815,281 filed on Apr. 24, 2013, and incorporated herein by reference.

FIELD OF THE INVENTION

The present invention relates to the field of Adaptive Noise Cancellation (ANC) systems. In particular, the present invention is directed toward a metric and tool to evaluate secondary path design in adaptive noise cancellation systems to improve performance of adaptive noise cancellation systems.

BACKGROUND OF THE INVENTION

A personal audio device, such as a wireless telephone, includes an adaptive noise canceling (ANC) circuit that adaptively generates an anti-noise signal from a reference microphone signal and injects the anti-noise signal into the speaker or other transducer output to cause cancellation of ambient audio sounds. An error microphone is also provided proximate the speaker to measure the ambient sounds and transducer output near the transducer, thus providing an indication of the effectiveness of the noise canceling. A processing circuit uses the reference and/or error microphone, optionally along with a microphone provided for capturing near-end speech, to determine whether the ANC circuit is incorrectly adapting or may incorrectly adapt to the instant acoustic environment and/or whether the anti-noise signal may be incorrect and/or disruptive and then take action in the processing circuit to prevent or remedy such conditions.

Examples of such Adaptive Noise Cancellation systems are disclosed in published U.S. Patent Application 2012/0140943, published on Jun. 7, 2012, and also in Published U.S. Patent Application 2012/0207317, published on Aug. 16, 2012, both of which are incorporated herein by reference. Both of these references are assigned to the same assignee as the present application and name at least one inventor in common and thus are not "Prior Art" to the present application, but are discussed herein to facilitate the understating of ANC circuits as applied in the field of use.

Referring now to FIG. 1, a wireless telephone 10 is illustrated in proximity to a human ear 5, or more specifically the pinna of a human ear. The pinna is the part of the human ear that extends from the head, and varies in shape and size between various individuals. As a result, the acoustical characteristics of a wireless telephone and the human ear will vary from person to person, based on the shape and size of their pinna 5. Moreover, how closely wireless telephone 10 is held to the pinna 5 will vary the acoustical characteristics and thus affect noise cancellation. For this reason as well as others, adaptive noise cancellation techniques are used to adaptively cancel background noise in a manner that is responsive to changes in the acoustical path between wireless phone 10 and pinna 5.

Wireless telephone 10 includes a transducer, such as speaker SPKR that reproduces distant speech received by wireless telephone 10, along with other local audio events such as ring tones, stored audio program material, injection of near-end speech (i.e., the speech of the user of wireless telephone 10) to provide a balanced conversational perception, and other audio that requires reproduction by wireless telephone 10, such as sources from web-pages or other network communications received by wireless telephone 10 and audio indications such as battery low and other system event notifications. A near-speech microphone NS is provided to capture near-end speech, which is transmitted from wireless telephone 10 to the other conversation participant (s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment, and is positioned away from the typical position of a user's mouth, so that the near-end speech is minimized in the signal produced by reference microphone R. A third microphone, error microphone E, is provided in order to further improve the ANC operation by providing a measure of the ambient audio combined with the audio reproduced by speaker SPKR close to ear pinna 5, when wireless telephone 10 is in close proximity to ear pinna 5. Exemplary circuit 14 within wireless telephone 10 includes an audio CODEC integrated circuit 20 that receives the signals from reference microphone R, near speech microphone NS and error microphone E and interfaces with other integrated circuits such as an RF integrated circuit 12 containing the wireless telephone transceiver. CODEC 20 may incorporate ANC circuitry to provide adaptive noise cancellation.

In general, ANC techniques measure ambient acoustic events (as opposed to the output of speaker SPKR and/or the near-end speech) impinging on reference microphone R, and also measures the same ambient acoustic events impinging on error microphone E. The ANC processing circuits of illustrated wireless telephone 10 adapt an anti-noise signal generated from the output of reference microphone R to have a characteristic that minimizes the amplitude of the ambient acoustic events at error microphone E.

Since acoustic path P(z) (also referred to as the Passive Forward Path) extends from reference microphone R to error microphone E, the ANC circuits are essentially estimating acoustic path P(z) combined with removing effects of an electro-acoustic path S(z) (also referred to as Secondary Path) that represents the response of the audio output circuits of CODEC IC 20 and the acoustic/electric transfer function of speaker SPKR including the coupling between speaker SPKR and error microphone E in the particular acoustic environment, which is affected by the proximity and structure of ear pinna 5 and other physical objects and human head structures that may be in proximity to wireless telephone 10, by the proximity and structure of ear pinna 5 and other physical objects and human head structures that may be in proximity to wireless telephone 10, and how firm the wireless telephone is pressed to ear pinna 5.

FIG. 2 is a block diagram illustrating the relationship between the elements of a type of ANC circuit known as Feed Forward ANC. The various types of ANC circuits (Feed-Forward, Feedback, and Hybrid) are described in more detail in the paper entitled *On maximum achievable noise reduction in ANC systems*, by A. A. Milani, G. Kannan, and I. M. S. Panahi, in Proc. ICASSP, 2010, pp. 349-352, published on March 2010 and incorporated herein by reference. The diagram of FIG. 2 is not an electrical block diagram, but rather illustrates the relationship of electrical, mechanical, and acoustical components in the overall system as shown in FIG. 1.

Input to the device is from reference microphone R, which outputs signal x(n) which represent the source of acoustic noise recorded by the reference microphone. The transfer function between the reference and error microphones is known as the Primary path P(z) or the passive forward path between error microphone E and the reference microphone R. Primary Path P(z) is represented in block 210. The noise signal after passing through P(z) is called d(n) which also represents the auto output received by error microphone E.

Secondary path S(z) is represented by block 230 and represents the transfer function of the electrical path, including the microphones E, R, and NS, digital circuitry (of FIG. 1), and canceling loudspeaker SPKR (of FIG. 1) plus the acoustical path between the loudspeaker SPKR (of FIG. 1) and the error microphone E. The input signal x(n) is fed to anti-noise filter 260 which has a transfer function W(z). The output y(n) from anti-noise filter 260 is then passed to adder 245, where it is added to a training signal (generally white noise) from Personal Entertainment System 290 (e.g., cellphone, pad device, or the like) and, after being inverted by inverter 255 (so as to subtract the resultant anti-noise signal) is input to secondary path transfer function 230. The output of this secondary path is added in adder 220 and the resultant signal e(n) is output to error microphone E via speaker SPKR (not shown).

SE(z) in block 280 represents an estimate of S(z). Due to the delay characteristics of the primary and secondary paths P(z), S(z), the feed-forward system of FIG. 2 may include an estimator to predict future noise and compensate for the delay characteristics in the overall system. Output signal e(n) is fed to adder 225 having an output that is inverted in inverter 235 and fed to least means square filter 250 which in turn generates a predicted S(z) filter value SE(z) in block 240. The output of block 240 in turn is fed into adder 225 in a feedback loop, so that this filter value is updated over time.

Predictive filter SE(z), that is shown as block 280, then accepts the input x(n) and uses the output through Least Means Squared filter 270 to create anti-noise filter value W(z) for anti-noise filter 260

The transfer function between the reference and error microphones is known as the Primary path P(z) or the passive forward path between error microphone E and the reference microphone R. The noise signal after passing through P(z) is called d(n).

Block 230 represents transfer function S(z) or the secondary path, which comprises the combined transfer functions of (a) a D/A converter, (b) a power amplifier, (c) speaker SPKR, (d) the air gap between speaker SPKR and error microphone E, (e) error microphone E itself, (f) an A/D converter, and (g) the physical structure of the audio device.

The ANC includes an adaptive filter (not shown) which receives reference microphone signal x(n), and under ideal circumstances, adapts its transfer function W(z) to be a ration of the primary path and secondary path (e.g., P(z)/S(z)) to generate the anti-noise signal. The coefficients of the adaptive filter 260 are controlled by a W(z) coefficient control block 260 that uses a correlation of two signals to determine the response of the adaptive filter, which generally minimizes, in a least-mean squares sense, those components of reference microphone signal x(n) that are present in error microphone signal.

The signals provided as inputs to LMS block 270 are the reference microphone signal x(n) as shaped by a copy of an estimate of the response of path S(z) provided by filter 280 and another signal provided from the output of a combiner 225 that includes the error microphone signal. By transforming reference microphone signal x(n) with a copy of the estimate of the response of path S(z),SE(z), and minimizing the portion of the error signal that correlates with components of reference microphone signal ref, adaptive filter 32 adapts to the desired response of P(z)/S(z).

One problem encountered in designing an adaptive noise cancellation system for a cellular telephone or other device is that the performance of an ANC system is very much dependent on the secondary path structure S(z). The secondary path contains the transfer functions of the D/A converter(s) and power amplifiers within integrated circuit 14, as well as the speaker, the air gap between the speaker and error microphone, the error microphone, A/D converter (s) within the integrated circuit 14, as well as the physical structure of the wireless telephone 10 itself.

Thus, in the prior art, a phone designer (or designer of other audio device) might place microphones and the speaker on the device based on aesthetic design criteria, or based on assumptions as to what would be a good location for a microphone or speaker. Only by building a testing model of the device could the designer evaluate the microphone and speaker placements. At that stage, it may be difficult to change the design if the microphone and speaker placements are found to be less than optimal. Moreover, testing each microphone and speaker combination and placement may be time consuming, particularly in terms of data acquisition and processing. Comparing different combinations of microphones and speakers and their placement, as well as phone case design and other secondary path variables may be difficult, as some combinations may provide superior performance in one frequency range, while others may provide better performance in other frequency ranges.

The inherent delay in the non-minimum phase S(z) is the major bottleneck which forces W(z) to be a predictor. This delay is mainly produced by the speaker transfer function and the air gap which corresponds to the relative placement of the speaker SPKR and the error microphone E. As a result, some of the zeros of S(z) fall outside the unit circle and make S(z) non-invertible. As transfer function W(z) is causal, if there is more delay, then the worse the performance of ANC system becomes. The physical structure and design of the audio system alter the transfer function S(z). There is no single metric that ANC designers and phone makers can use to evaluate the secondary path design (i.e., selection and placement of speaker and microphones, as well as the physical structure and design of the audio device).

Thus, it remains a requirement in the art to provide a metric and tool to evaluate secondary path design in an adaptive noise cancellation system, to allow designers to improve the design of such audio devices, and compare different designs more easily.

SUMMARY OF THE INVENTION

The present invention provides a system and method encompassing a new metric and MATLAB toolbox that phone makers may use to improve the design of the secondary path, in order to improve ANC performance. The metric measures how invertible the secondary path is and then evaluates ANC performance at a worst-case scenario where P(z)=1 and W(z) becomes a complete predictor. The invention can be easily extended to a multi-channel ANC system.

DETAILED DESCRIPTION OF THE INVENTION

Figure 1:
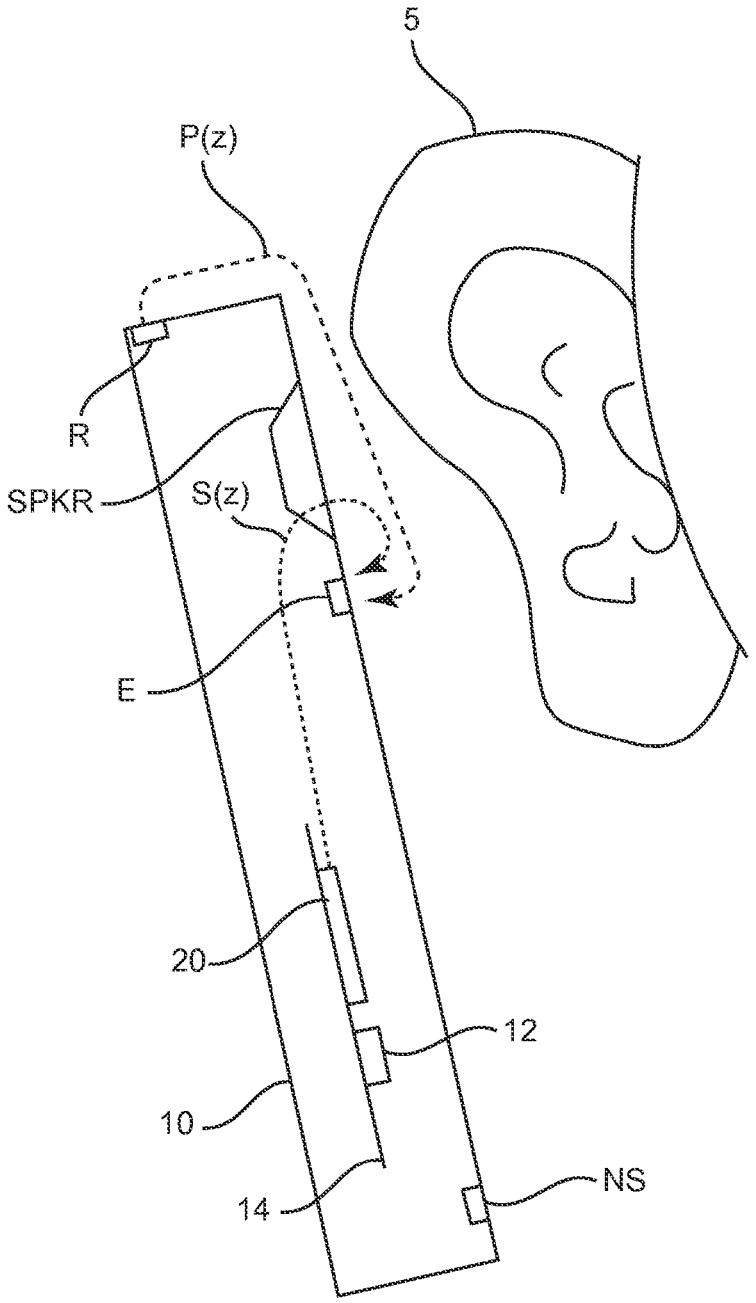
FIG. 1 is an illustration of a wireless telephone 10 in accordance with an embodiment of the present invention.
Figure 2:
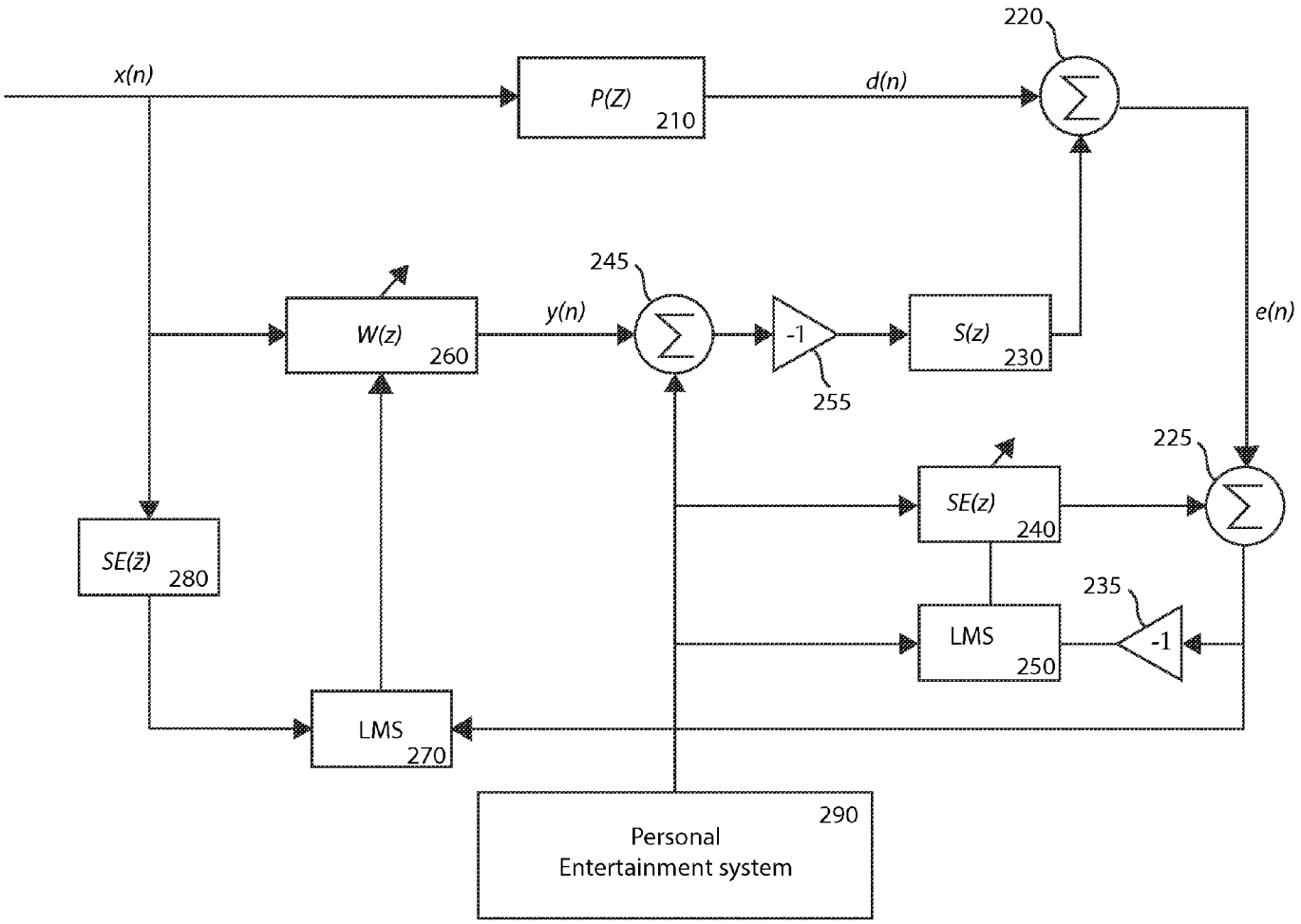
FIG. 2 is a block diagram illustrating the electrical, acoustical, and physical relationships between the elements of a type of ANC circuit known as Feed Forward ANC.
Figure 3:
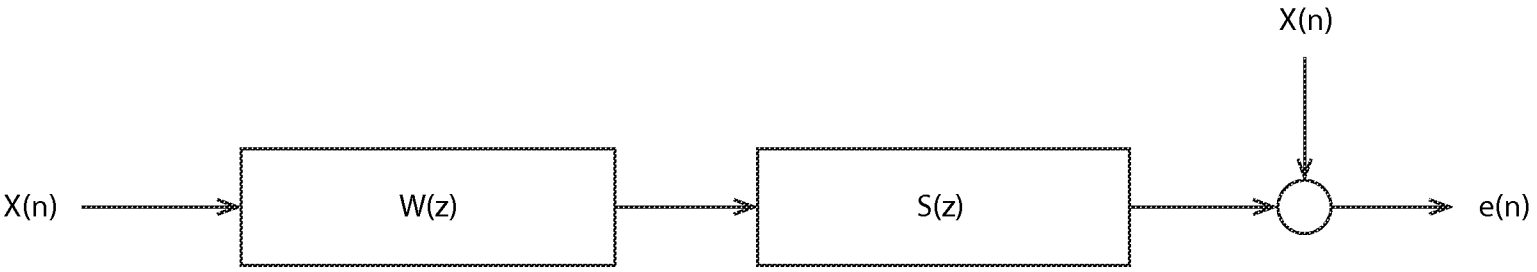
FIG. 3 is a simplified block diagram illustrating how the noise reduction metric is measured.

FIG. 3 is a simplified block diagram of the design metric of the present invention, where W(z) represents the transfer function of the noise reduction filter and S(z) represents the secondary path transfer function. Signal x(n) represents the noise signal to be cancelled, while e(n) represents the error signal, or difference between the noise signal and the anti-noise coming out of transfer function S(z). When the error e(n)=0 (in an ideal filter), transfer function W(z) then becomes the causal inverse of the transfer function S(z). The amount of noise reduction between 100 Hz-3 kHz is then measured as the metric of invertibility.

A Causal Wiener solution can be calculated as the Least Means Squared (LMS) filter moves toward $W_0$ as the optimal causal Wiener solution, according to equation (1) below, where Ambient noise Power Spectral Density (PSD) is determined by equation (2) and S(z) is determined by equation (3):

$$w_o = \frac{1}{S_{MP}(z)\cdot\Gamma_x(z)}\left\{\frac{P(z)\cdot\Gamma_x(z)}{S_{AP}(z)}\right\}_+ \tag{1}$$

$$\Gamma_{xx}(z)\Gamma x(z)\cdot\Gamma_x(z^{-1})= \tag{2}$$

$$S(z)=S_{MP}(z)\cdot S_{AP}(z) \tag{3}$$

where $S_{MP}(Z)$ is the minimum phase factor, $S_{AP}(z)$ is the all pass factor and $\Gamma_{xx}(z)$ is the power spectral density. From these equations, it is determined that $S_{AP}(z)$ is the non-minimum phase, and thus has zeros outside the unit circle and has a delay.

The inherent delay in the non-minimum phase S(z) is the major bottleneck which forces transfer function W(z) to be a predictor. This delay is mainly produced by the speaker transfer function and the air gap which corresponds to the relative placement of the speaker SPKR and the error microphone E. As a result, some of the zeros of the transfer function S(z) fall outside the unit circle and make S(z) non-invertible. As transfer function W(z) is causal, if more delay exists in the transfer function S(z) then the worse the performance of ANC system becomes. In the prior art, there is no single metric that ANC designers (phone makers) can use to evaluate a secondary path design, such as selection and placement of speaker and microphones, and altering physical structure and design of audio device.

Figure 4A:
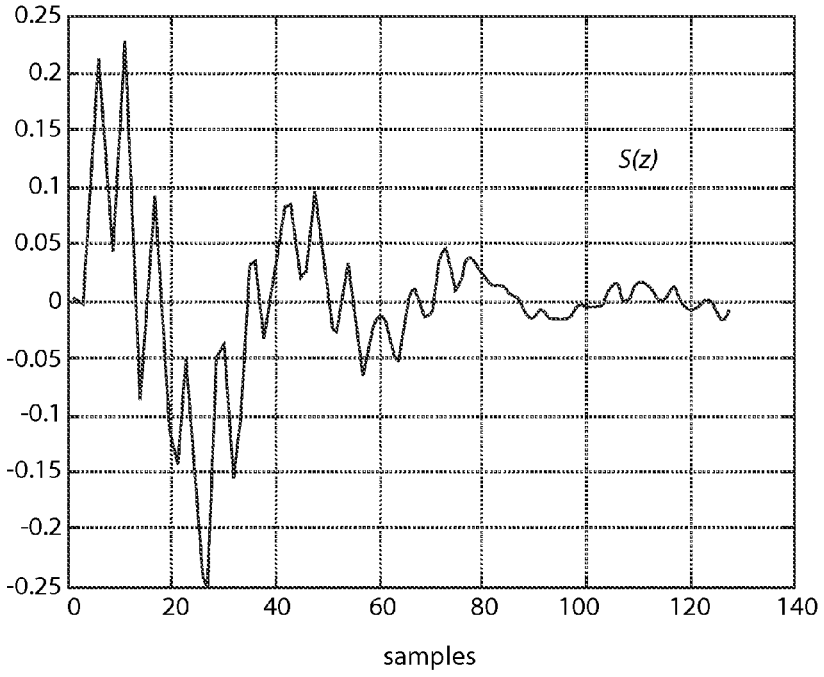
FIG. 4A is a graph illustrating the secondary path response.
Figure 4B:
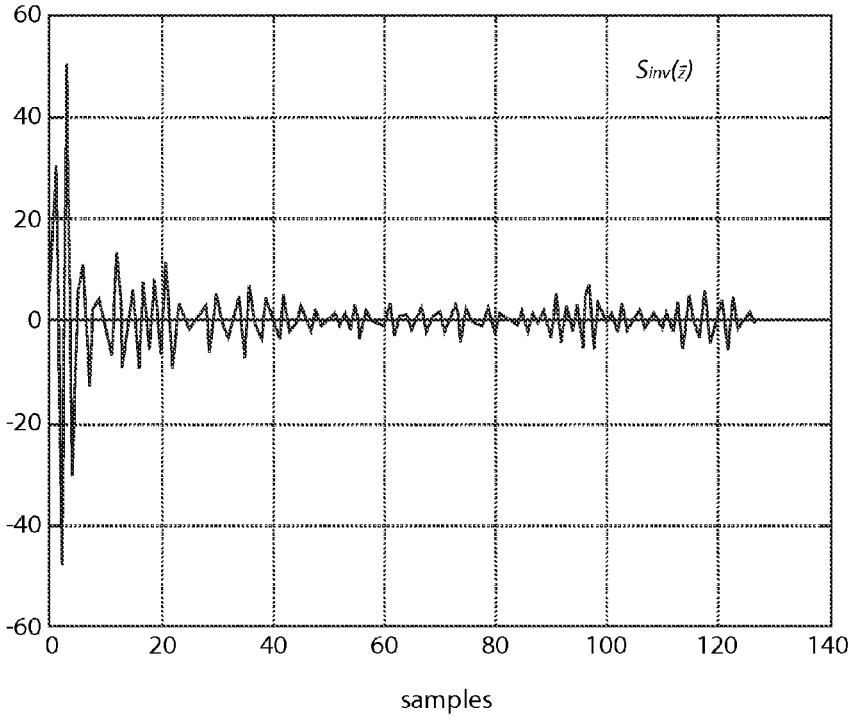
FIG. 4B is a graph illustrating the inverse of the secondary path transfer function S(z).
Figure 5A:
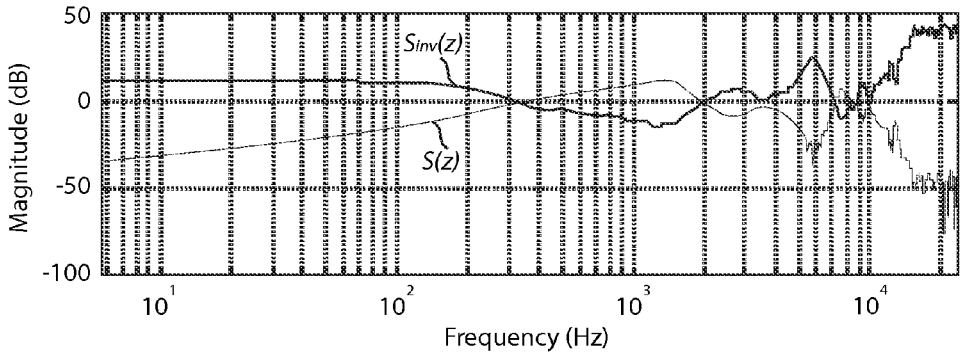
FIG. 5A is a graph illustrating the frequency response of the secondary path transfer function S (z) and its inverse.
Figure 5B:
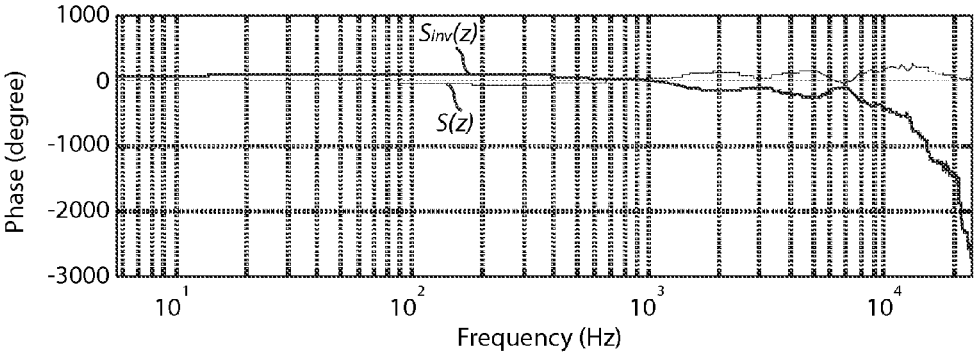
FIG. 5B is a graph illustrating the phase response of the secondary path transfer function S(z) and its inverse.

FIG. 4A is a graph illustrating the secondary path response S(z), and FIG. 4B is a graph illustrating the inverse of the secondary path transfer function S(z), both of which are in the sample domain. FIG. 5A is a graph illustrating the frequency response of the secondary path transfer function S(z) and its inverse. FIG. 5B is a graph illustrating the phase response of the secondary path transfer function S(z) and its inverse. As illustrated in these two figures, the inverted secondary path response $S_{inv}(z)$ is not a mirror image of the secondary path response S(z) in terms of either amplitude or phase. The invertability is proportional to the performance of the error correction circuit.

Figure 6:
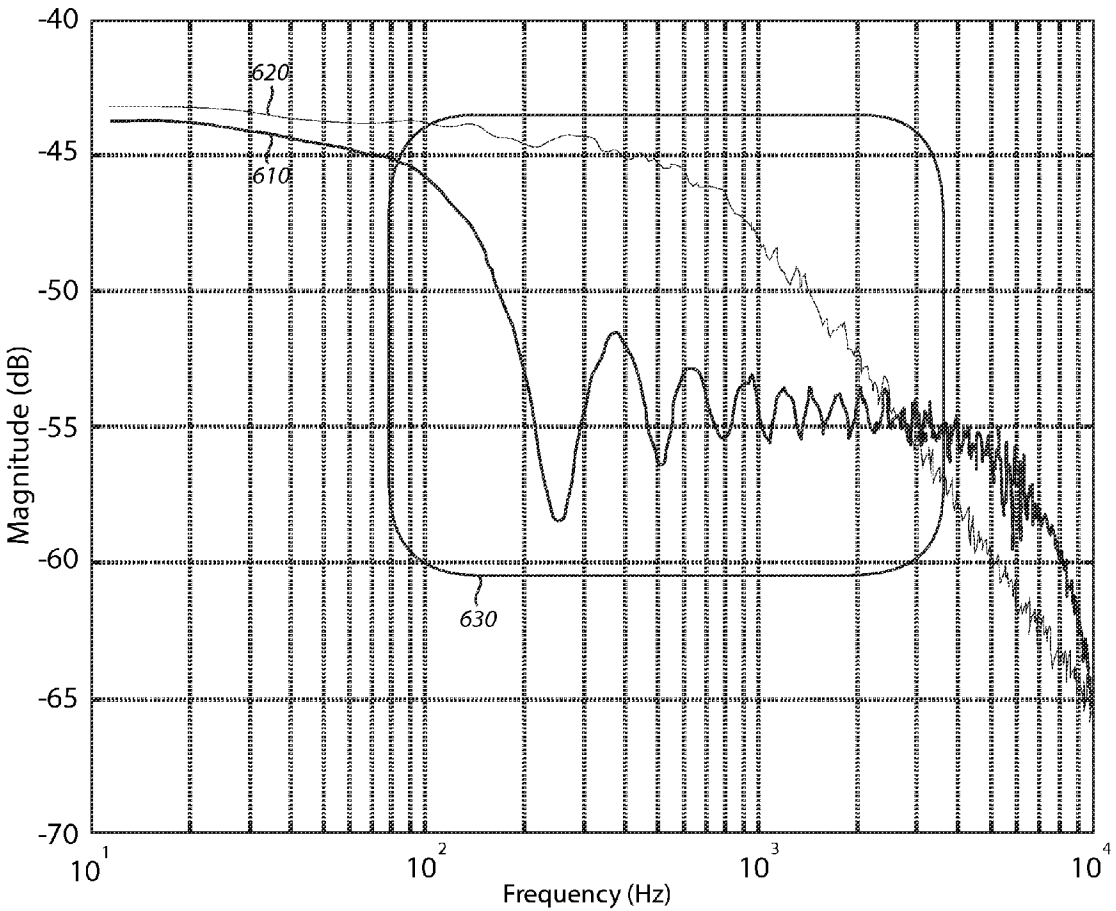
FIG. 6 is s a graph illustrating the amount of cancellation achieved using the inverse of the secondary path transfer function.

FIG. 6 is a graph illustrating the amount of cancellation achieved when transfer function W(z) is the inverse of the secondary path transfer function. Referring to FIG. 6, line 620 represents the spectrum of noise signal x(n), while line 610 represents the spectrum of error signal e(n). When the amount of error is lower, the delay is lesser and the more invertible is the secondary path S(z) and more effectively is the noise cancellation system working. The amount of noise reduction between 100 Hz-3 kHz as illustrated in window 630 is then measured as the metric of invertibility.

Figure 7:
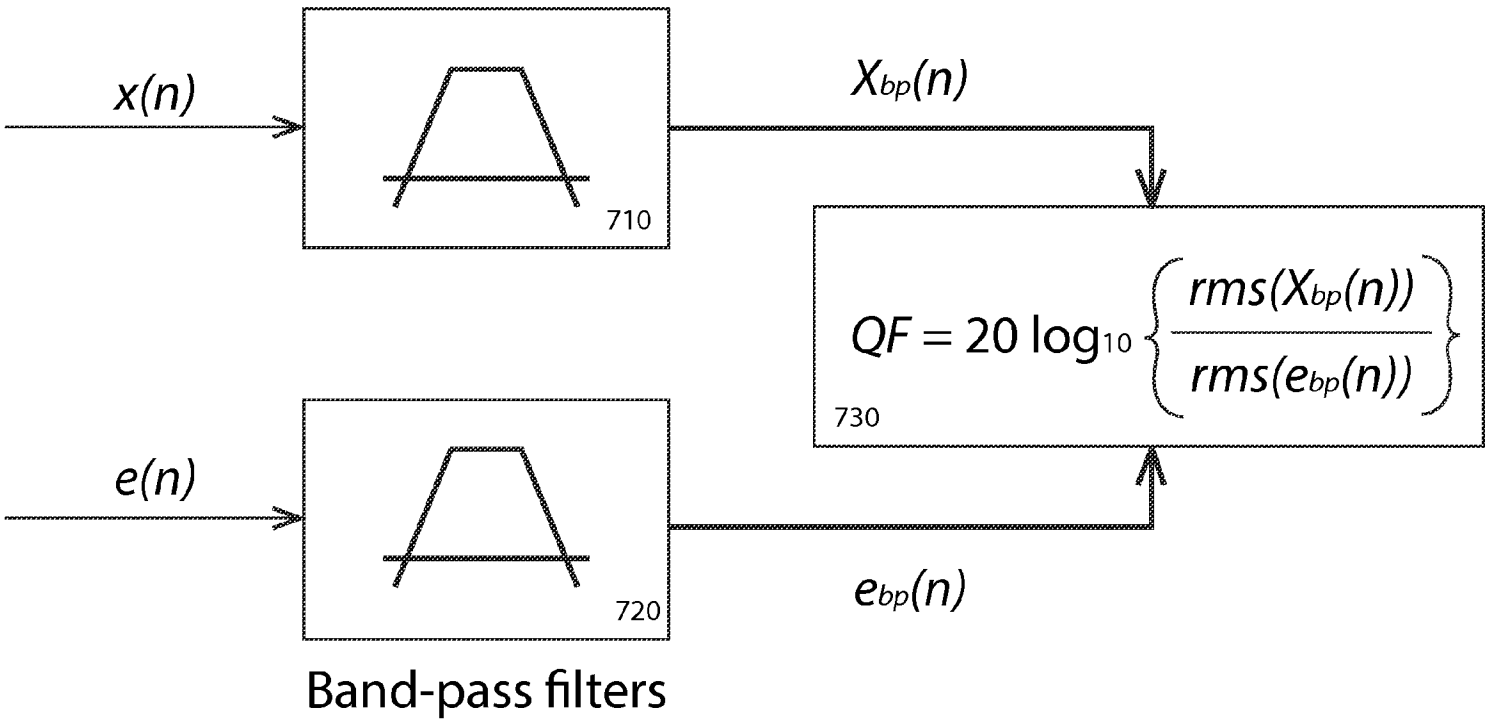
FIG. 7 is a block diagram illustrating how the quality factor metric is calculated.

FIG. 7 is a block diagram illustrating how the quality factor metric is calculated. Signals x(n), the noise to be cancelled, and e(n), the error signal, are fed to respective bandpass filters 710 and 720 to produce filtered input signals $x_{bp}(n)$ and $e_{bp}(n)$ respectively. The bandpass filters 710 and 720 may be used to filter out a region of interest, such as the 100 Hz-3 kHz window 630 of FIG. 6. The quality factor may then be computed as follows:

$$QF = 20\log_{10}\left(\frac{\mathrm{rms}(x_{bp}(n))}{\mathrm{rms}(e_{bp}(n))}\right) \tag{4}$$

This quality factor, as will be discussed in more detail in connection with FIGS. 8-13, may be used to judge the effects of modifications to secondary path in one phone or audio device, versus another phone device, in terms of efficacy in the operation of the ANC circuit.

Figure 8:
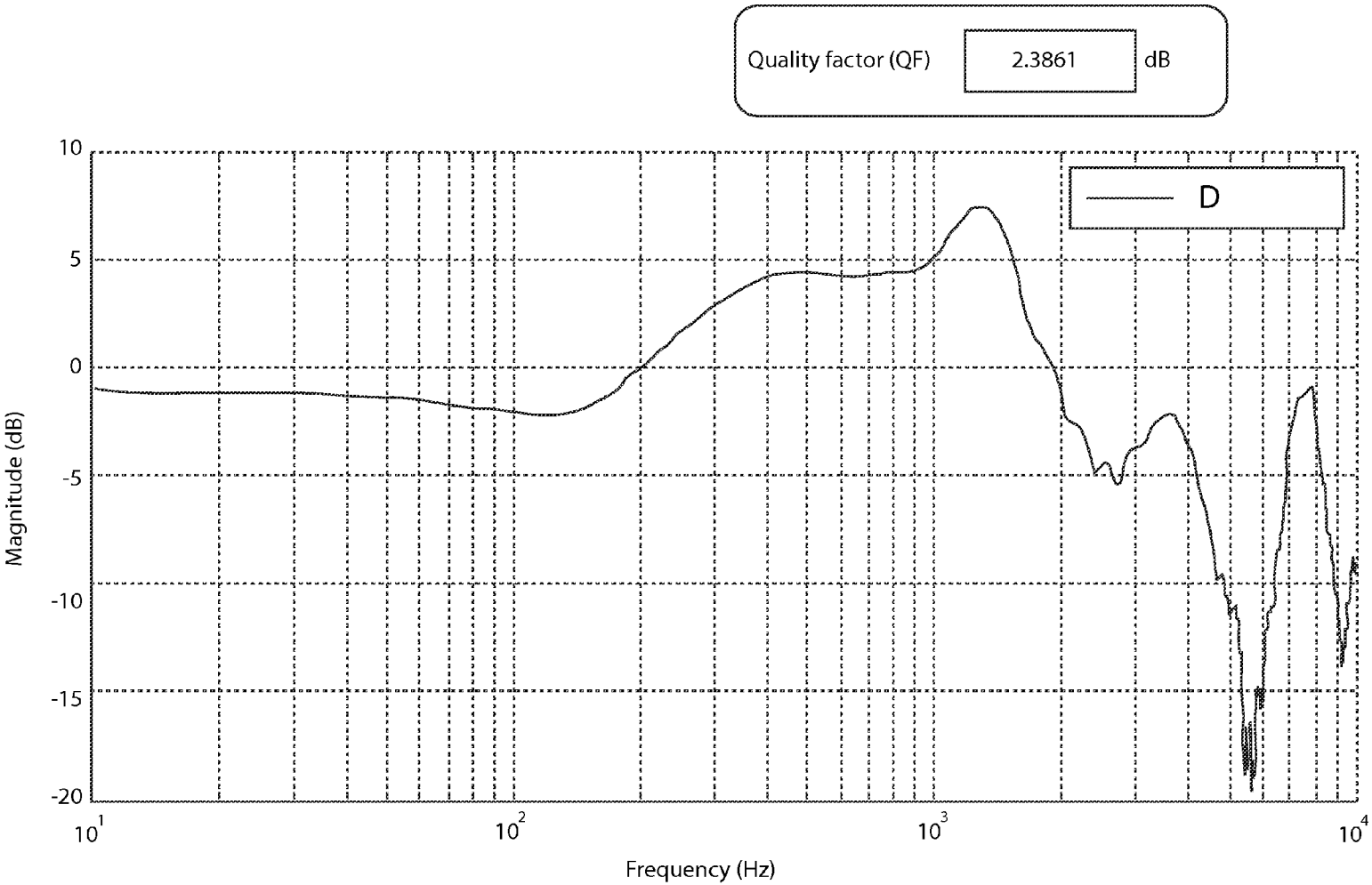
FIG. 8 is a graph illustrating the frequency response of the secondary path transfer function to a particular portable device, and the resultant quality factor.

FIG. 8 is a graph illustrating the frequency response of the secondary path transfer function to a particular portable device and the resultant quality factor. In the graph of FIG. 8, the frequency response of the secondary path function is illustrated, along with the quality factor calculated according to equation (4). As illustrated in FIG. 8, the quality factor value provides a simple numerical indicator or metric, which is easier to compare to other devices and configurations than raw graphical data.

Figure 9:
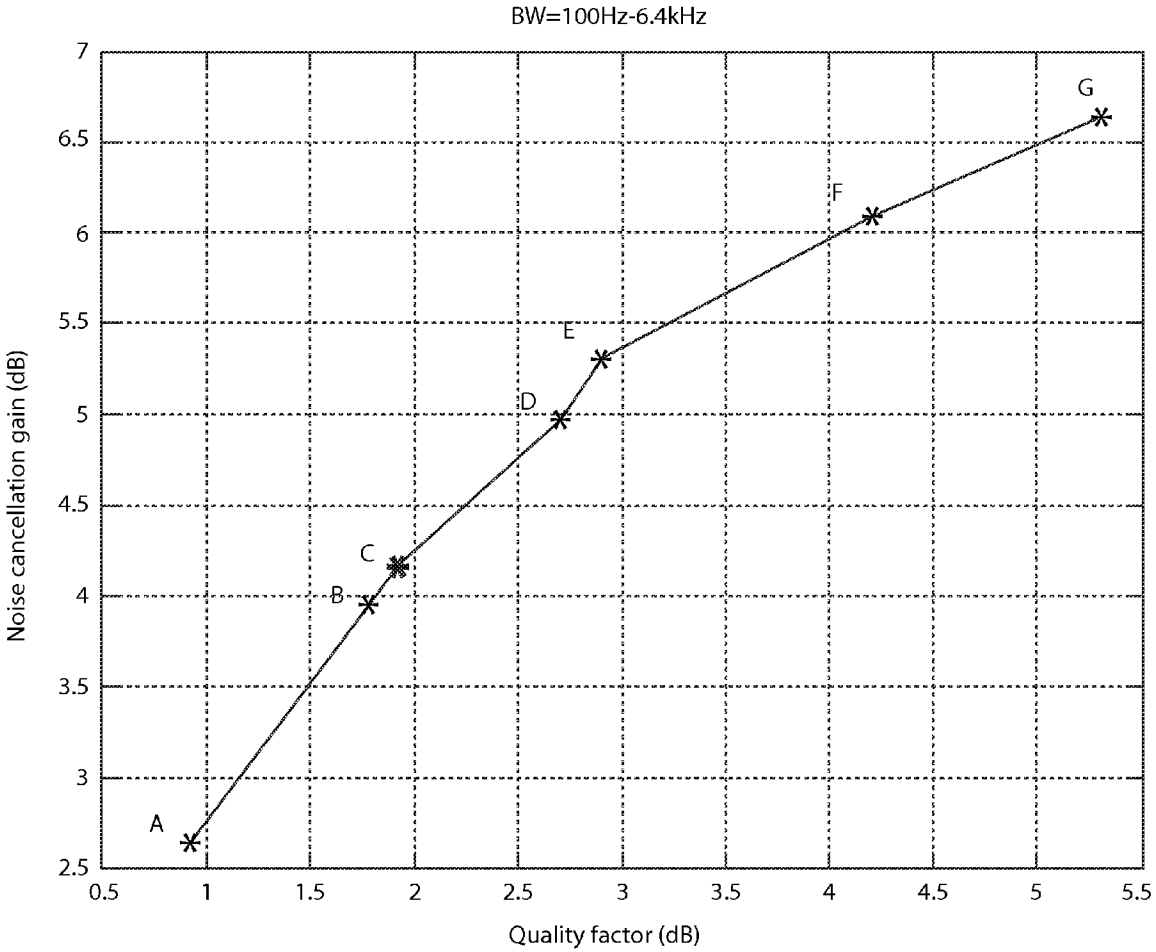
FIG. 9 is a graph illustrating noise cancellation gain versus quality factor for a number of different portable devices, illustrating the linear relationship between noise cancellation gain and quality factor.

FIG. 9 is a graph illustrating noise cancellation gain versus quality factor for a number of different portable devices, illustrating the linear relationship between noise cancellation gain and quality factor. The X-axis of FIG. 9 represents quality factor as measured for one of the seven different phones evaluated, A-G. The Y-axis shows the noise cancellation, in dB, in the bandwidth of 100 Hz to 6.4 kHz.

Phones A, B, C, D, E, F, and G, may represent phones from various manufacturers and various models from the same manufacturer, as tested using the secondary path evaluation system and method. As illustrated in FIG. 9, if a line is drawn between the data points represented by phones A, B, C, D, E, F, and G, it forms a relatively straight line having a constant slope, showing a substantially linear relationship between the quality factor calculated by the secondary path evaluation system and method, and the actual noise cancellation gain. FIG. 9 validates that the secondary path evaluation system and method provides an accurate metric for evaluating secondary path, regardless of phone type or model, or other factors affecting secondary path (e.g., microphone placement, speaker placement, microphone type, speaker type, and the like).

Figure 10:
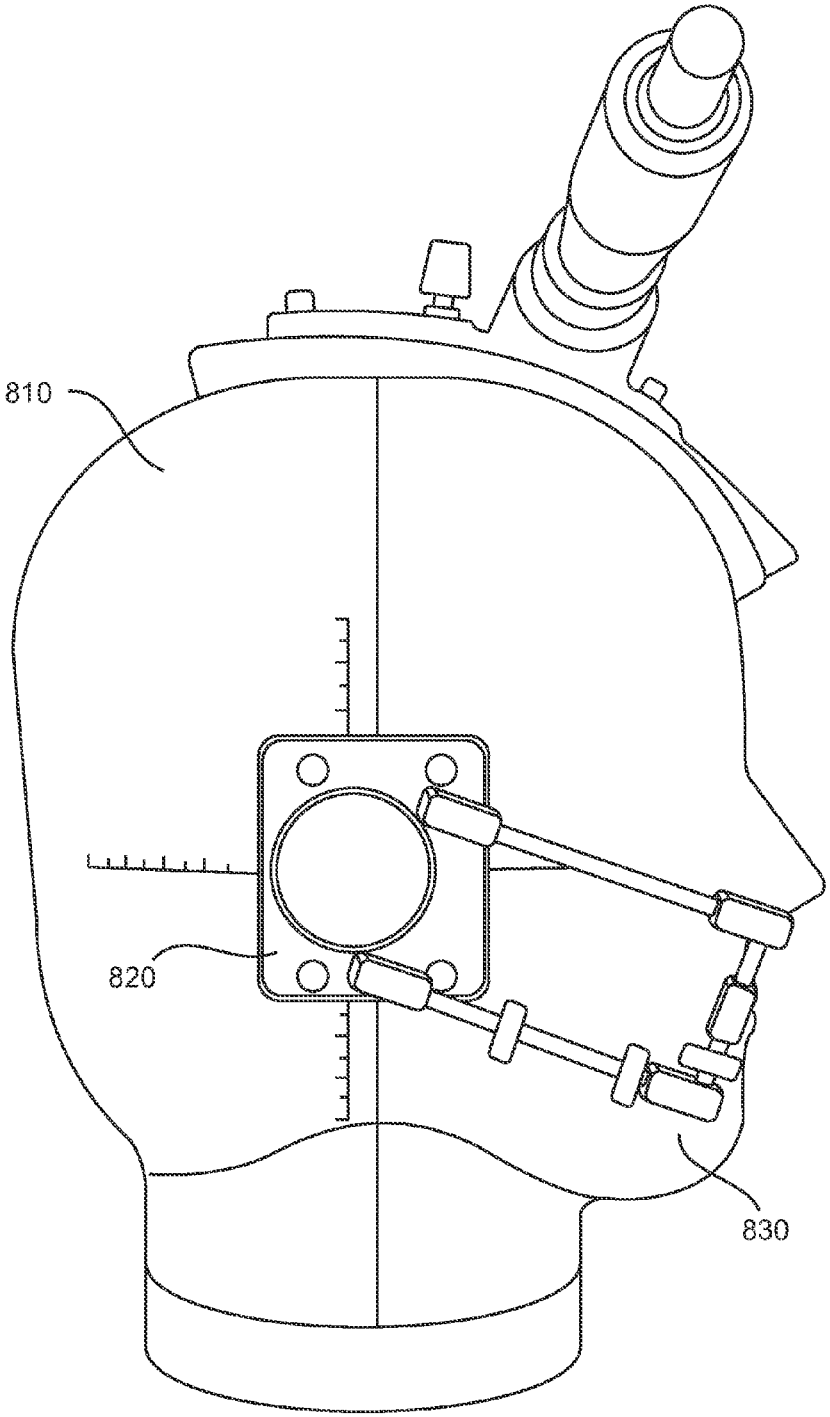
FIG. 10 is a side view of the pinna test dummy used to test a cell phone to evaluate secondary path design.

FIG. 10 is a side view of the pinna test dummy used to test a cell phone to evaluate secondary path design. The secondary path evaluation system utilizes such a dummy head to simulate the placement of a cellular phone or other communication device near the pinna (ear lobe) and head of a human being. The shape and size of the human ear varies considerably, as well as the placement of a phone near the ear.

Testing for various ear shapes and spacing combinations is not worthwhile, as the phone manufacturer has no control as to how the user places the phone or the shape of the user's ear—which changes the nature of the secondary path. One goal of an adaptive noise cancellation system is to adapt or modify the cancellation signal based on these changes in the secondary path. Thus, the standard pinna head 810 is used, to test various phones and models of phones, as well as variations in the designs of these phones (microphone and speaker design and placement, for example) and provide a standardized "head" that may be used to provide a baseline for design comparisons.

Pinna head 810 includes a simulated ear pinna 820, which is designed to mimic the acoustical characteristics of a human ear pinna. Bracket 830 is attached to pinna head 810 to hold the cell phone or other audio device in a fixed and measured relationship to pinna 820. When testing, a technician or engineer may place a cell phone (not shown) into bracket 830 for testing purposes. Since bracket 830 may be fixed to a desired position, a phone may be tested repeatedly, after various modifications are made, in the same position and orientation as previous tests.

Figure 11:
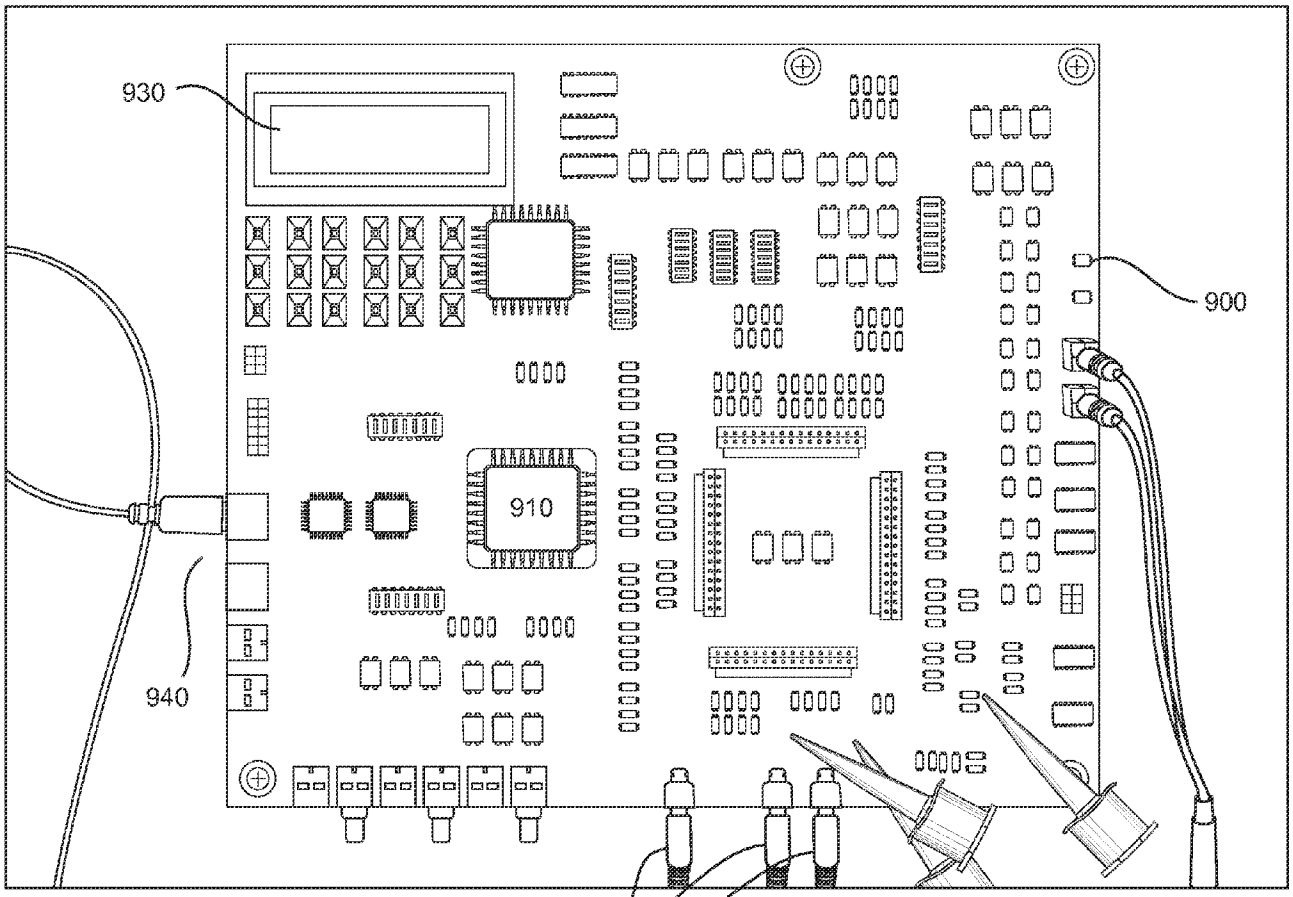
FIG. 11 is an applications test board used in evaluating an adaptive noise reduction system in conjunction with the pinna test dummy of FIG. 9.

FIG. 11 shows an applications test board used in evaluating an adaptive noise reduction system in conjunction with the Pinna test dummy of FIG. 10. An applications test board, or development board may be offered by a semiconductor manufacturer, for a nominal fee or free, to customers or potential customers, experimenters, and the like, who wish to test the operation of a semiconductor device. In this instance, applications test board 900 is designed for testing and development of an adaptive noise cancellation semiconductor device 910, which may be placed in a socket on the test board 900. A display 930 may be used to display various data, or data may be output to a computer system or other data acquisition device through data port 940. Various leads 950 may be coupled to a cell phone or other device under test, such as a cell phone mounted to pinna head 810 of FIG. 9.

One advantage of the secondary path evaluation system and method is that a standard applications test board may be used without significant modification. Thus, the system and method may be provided to a customer for the semiconductor device (e.g., cell phone manufacturer), without incurring significant cost for the manufacturer or the customer.

Figure 12:
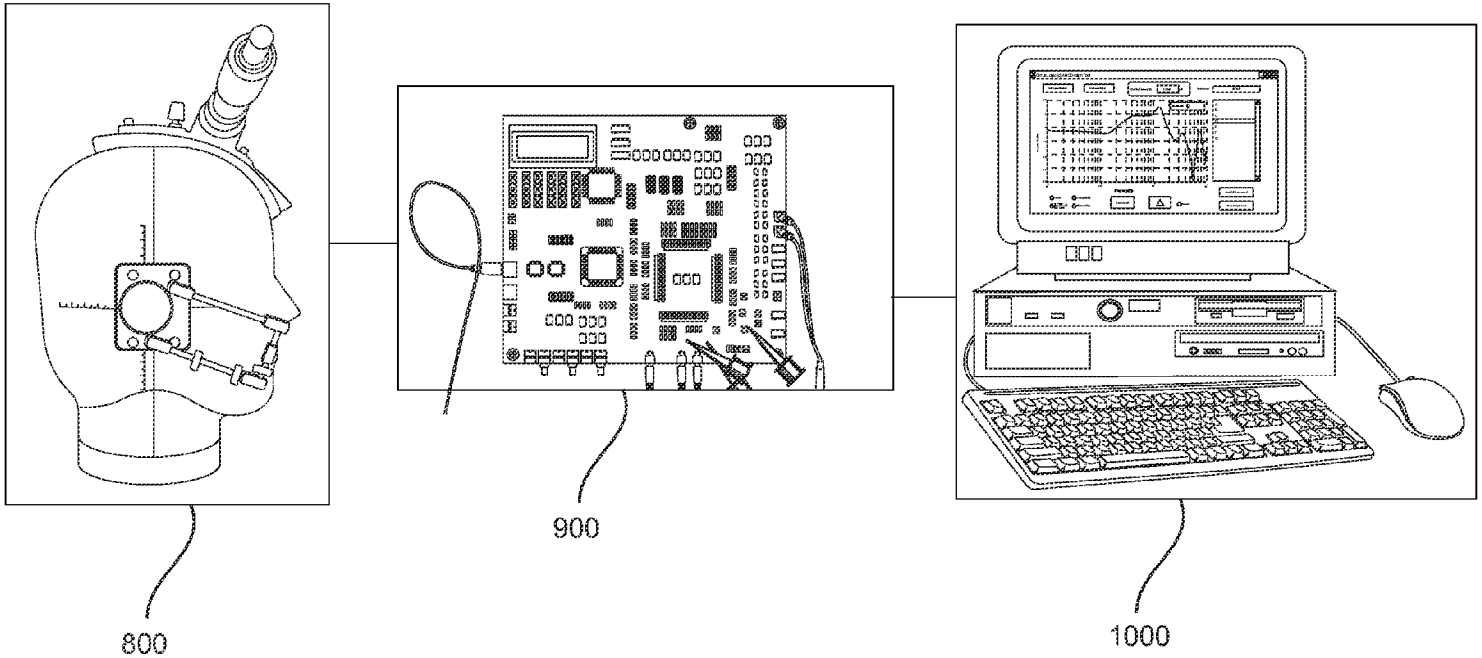
FIG. 12 is a simplified block diagram of the test system as assembled, showing the pinna test dummy, applications test board, and computer system displaying the secondary path evaluation metric.

FIG. 12 is a simplified block diagram of the test system as assembled, showing the Pinna test dummy, applications test board, and computer system displaying the secondary path evaluation metric. Referring to FIGS. 10-12, when developing a cell phone design, an engineer or technician may mount a cell phone or other audio device to be tested, onto the mounting bracket 830 of pinna head 800. Internal connections from the speaker, error microphone, and reference microphone may then be coupled to inputs 950 of applications test board 900, using suitable jumpers and cabling. Output 940 may be coupled to a computer, such as a personal computer (PC) or workstation 1000, or the like, where data may be accumulated, processed and stored. Using the measured secondary path model, the system then calculates and generates a quality factor for each device and device configuration tested, and displays this data, as well as other test data, graphically on the computer 1000.

Figure 13:
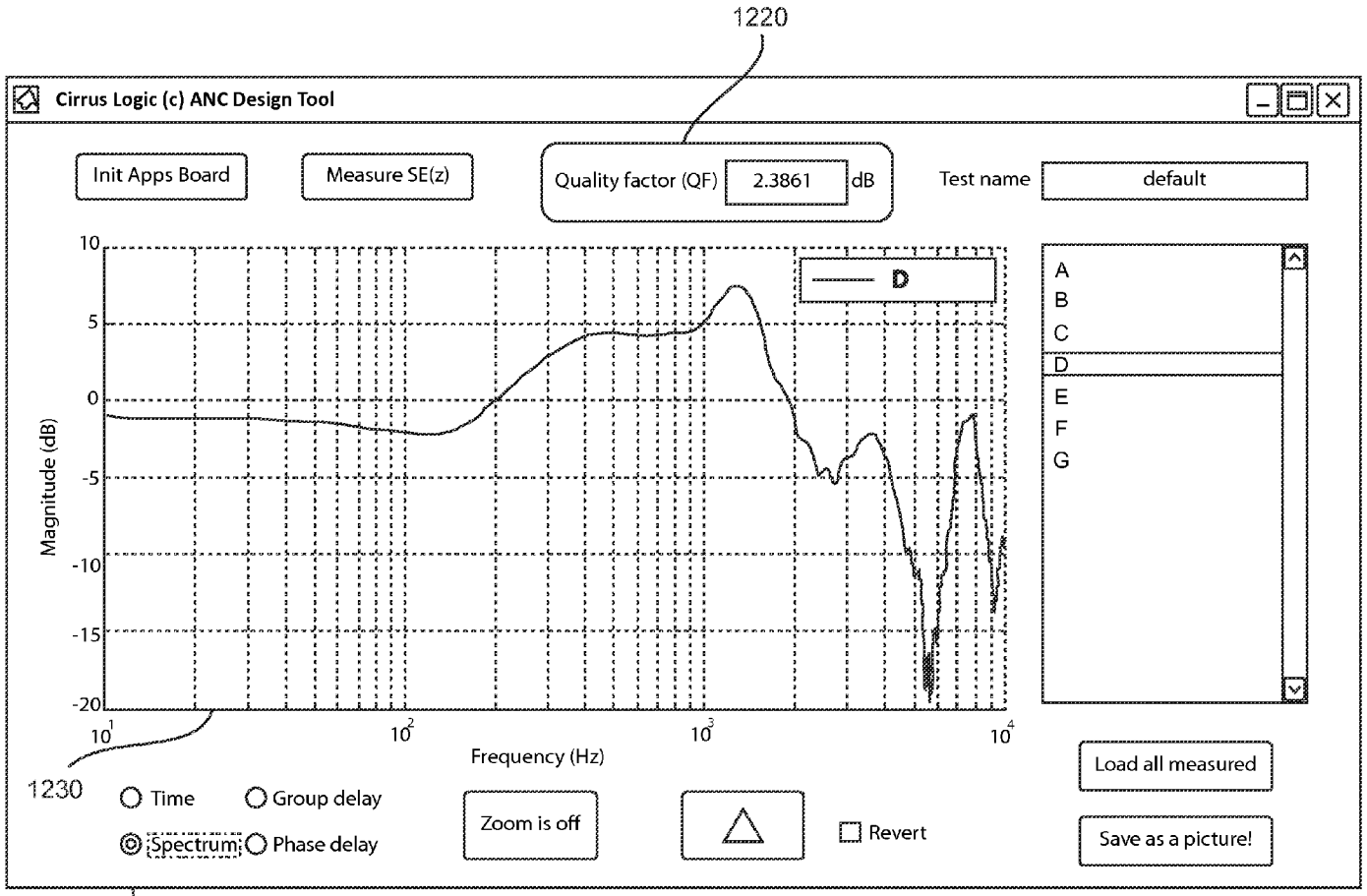
FIG. 13 is a screen shot of the display in the computer 1000 of FIG. 11, illustrating the displayed metric and other data relating to secondary path evaluation.

FIG. 13 is a screen shot of the display in the computer 1000 of FIG. 12, illustrating the displayed metric and other data relating to secondary path evaluation. Referring to FIG. 13, the display 1210 may appear on computer 1000 of FIG. 12. Various data elements may be displayed on the screen for one or more of the devices tested, for example, phones A, B, C, D, E, F, and G of FIG. 9. In this instance, graph 1230 of FIG. 8 is displayed, representing cell phone configuration D, as referenced in FIG. 9. A quality factor for this cell phone configuration 1220 is shown at the top of the screen.

From the data on screen 1210, an engineer or technician can compare the performance of one cell phone configuration against another by comparing the quality factor of one configuration to another. Rather than have to make extensive calculations as to noise cancellation at various frequencies, and make subjective judgments as to whether noise cancellation at different frequencies are comparable to noise cancellation at other frequencies, the quality factor 1220 provides a direct metric of quality of noise cancellation that can be compared across product lines, manufacturers, and configurations.

Once a particular phone configuration has been tested, the engineer or technician may then reconfigure the phone, for example, by moving the location of the error or reference microphones, or the location of the speaker. Different brands and models of microphones and speakers from different suppliers may be compared, to determine how these changes affect the secondary path performance. Placement and location of microphones and speakers may often be dictated by aesthetic design considerations, and type and model of speaker and microphone may be subject to cost constraints. For an engineer, juggling all of these design criteria is difficult enough, without some way of quickly and easily testing and evaluating such designs. The Quality Factor generated by the secondary path evaluation system and method simplifies this testing procedure, allowing an engineer to optimize his design in less time, at less cost.

The present invention may also be applied to grade a number of transducers in terms of their noise cancellation properties. A particular transducer (e.g., microphone, speaker, or the like) may be applied to a particular configuration of portable device components, and the overall system tested as previously described. Other transducers may then be substituted into the configuration, and the test repeated. Once a number of different transducers have been thus tested, the quality factors may then be compared to show the difference in performance and thus grading of different transducer types, brands, or models. As such, the system and method of the present invention may be applied to test individual components, as well as the overall system.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A system for of evaluating performance of a portable device including at least a speaker, a reference microphone, and an error microphone, and an adaptive noise cancellation circuit having an anti-noise filter with a transfer function W(z), the tool system comprising:

a testing apparatus measuring a secondary path transfer function S(z) representing the response of the electronic components in the portable device, and acoustic/electric transfer function of the speaker, including acoustical coupling between the speaker and the error microphone in a predetermined acoustical environment of the portable device, wherein the testing apparatus includes a pinna test dummy holding the portable device in a predetermined physical configuration to emulate the predetermined acoustical environment, and an application test board configured to accept the adaptive noise cancellation circuit, and wherein the testing apparatus determines a quality factor QF for a predetermined acoustical environment by measuring invertability of the transfer function W(z) relative to the secondary path transfer function S(z) as an indicia of performance of the secondary path of the portable device.

2. The system of claim 1, wherein the secondary path transfer function S(z) comprises combined transfer functions of a D/A converter, a power amplifier, a speaker, the air gap between speaker and the error microphone, the error microphone, an A/D converter, and the physical structure of the audio device.

3. The system of claim 2, wherein the quality factor QF is determined by:

$$QF = 20\log_{10}\left(\frac{\mathrm{rms}(x_{bp}(n))}{\mathrm{rms}(e_{bp}(n))}\right)$$

where x(n) represents a spectrum of a noise signal from the reference microphone, where e(n) represents a spectrum of error signal from the error microphone, where $x_{bP}$ (n) represents the spectrum of noise signal x(n) passed through a bandpass filter to filter out a region of interest, and where $e_{bP}$ (n) represents the spectrum of error signal e(n) passed through a bandpass filter to filter out a region of interest.

4. The system of claim 1, wherein the region of interest ranges from substantially 100Hz to substantially 3kHz.

5. A method of evaluating performance of a portable device including at least a speaker, a reference microphone, and an error microphone, and an adaptive noise cancellation circuit, the method comprising:

receiving signals in an audio coder/decoder from the reference microphone, and the error microphone, generating an anti-noise signal in an anti-noise filter coupled to the audio coder/decoder as a predetermined function of an acoustic passive forward path P(z) extending from the reference microphone to the error microphone, to minimize amplitude of ambient acoustic events at the error microphone, the anti-noise filter having a transfer function W(z), estimating the acoustic passive forward path P(z) combined with removing effects of an electro-acoustic secondary path S(z) representing the response of audio output circuits of the audio coder/decoder and an acoustic/electric transfer function of the speaker, including acoustical coupling between the speaker and the error microphone in a predetermined acoustical environment of the portable device, and evaluating performance of the portable device for the predetermined acoustical environment by measuring invertability of the transfer function W(z) relative to the electro-acoustic secondary path a transfer function S(z) as an indicia of performance of the secondary path of the portable device.

6. The method of claim 5, comprising:

determining a quality factor QF from the invertability of the transfer function W(z) relative to the electro-acoustic secondary path transfer function S(z);

optimizing performance of portable device for the predetermined acoustical environment by selecting a configuration for the portable device having an optimized quality factor QF.

7. The method of claim 5, comprising:

determining a quality factor QF from the invertability of the transfer function W(z) relative to the electro-acoustic secondary path S(z);

comparing performance of a plurality of portable devices for the predetermined acoustical environment by comparing quality factor QF values of each of the plurality of portable devices.

8. The method of claim 6, wherein the quality factor QF is determined by:

$$QF = 20\log_{10}\left(\frac{\mathrm{rms}(x_{bp}(n))}{\mathrm{rms}(e_{bp}(n))}\right)$$

where x(n) represents a spectrum of a noise signal from the reference microphone, where e(n) represents a spectrum of error signal from the error microphone, where $x_{bp}$(n) represents the spectrum of noise signal x(n) passed through a bandpass filter to filter out a region of interest, and where $e_{bp}(n)$ represents the spectrum of error signal e(n) passed through a bandpass filter to filter out a region of interest.

9. The method of claim 8, comprising:

estimating a transfer function $_{SE}(z)$ of the electro-acoustic secondary path transfer function S(z) to compensate for delay characteristics of the acoustic passive forward path P(z) and the electro-acoustic secondary path transfer function S(z), filtering in a first least means square filter receiving the error signal e(n) that is inverted, to generate a predicted S(z) filter value SE(z). feeding back the filtered error signal e(n) into the first least means square filter in a feedback loop, so that filter value SE(z) is updated over time, predictive filtering, using the estimate transfer function SE(z) accepting input x(n) and outputting a predictive value, and filtering, with a second least means squared filter, the predictive value and outputting a value to generate anti-noise filter transfer function W(z).

10. The method of claim 9, wherein the region of interest ranges from substantially 100 Hz to substantially 3 kHz.

11. A system for testing a portable device, the portable device including at least a speaker, a reference microphone, an error microphone, and an adaptive noise cancellation circuit, the system comprising:

a test stand for holding the portable device in a predetermined configuration and emulating a predetermined acoustical environment for the portable device;

an interface, coupled to the portable device for emulating operation of the adaptive noise cancellation circuit in the portable device, including an anti-noise filter coupled to the audio coder/decoder, generating an anti-noise signal as a predetermined function of the acoustic passive forward path P(z) extending from the reference microphone to the error microphone, to minimize amplitude of ambient acoustic events at the error microphone, the anti-noise filter having a transfer function W(z) and the adaptive noise cancellation circuit estimates the acoustic passive forward path P(z) combined with removing effects of an electro-acoustic secondary path S(z) representing the response of audio output circuits of the audio coder/decoder and an acoustic/electric transfer function of the speaker, including acoustical coupling between the speaker and the error microphone in a predetermined acoustical environment of the portable device;

a processor, coupled the interface and receiving transfer function data for the anti-noise filter having a transfer function W(z) and the electro-acoustic secondary path transfer function S(z), and adapted to calculate a quality factor for the portable device as a function of the invertability of the transfer function the anti-noise filter W(z) relative to the electro-acoustic secondary path transfer function S(z); and a display, coupled to the processor, for displaying the quality factor for the portable device in the predetermined configuration.

12. The system for testing a portable device of claim 11, wherein the adaptive noise cancellation circuit in the interface includes an adaptive filter receiving reference microphone signal x(n), and adapting the transfer function W(z) to be a ratio of the acoustic passive forward path transfer function P(z) and the electro-acoustic secondary path transfer function S(z) to generate an anti-noise signal.

13. The system for testing a portable device of claim 12, wherein a quality factor QF is determined by the invertability of the transfer function W(z) relative to the electro-acoustic secondary path transfer function S(z) and the system for testing a portable device is optimized for performance for the predetermined acoustical environment by selecting a configuration for the system for testing a portable device having an optimized quality factor.

14. The system for testing a portable device of claim 13, wherein the quality factor QF is determined by:

$$QF = 20\log_{10}\left(\frac{\mathrm{rms}(x_{bp}(n))}{\mathrm{rms}(e_{bp}(n))}\right)$$

where x(n) represents a spectrum of a noise signal from the reference microphone, where e(n) represents a spectrum of error signal from the error microphone, where $x_{bp}(n)$ represents the spectrum of noise signal x(n) passed through a bandpass filter to filter out a region of interest, and where $e_{bp}(n)$ represents the spectrum of error signal e(n) passed through a bandpass filter to filter out a region of interest.

15. The system for testing a portable device of claim 14, further comprising:

an estimator generating an estimate transfer function $_{SE}(z)$ of electro-acoustic secondary path transfer function S(z) to compensate for delay characteristics of the acoustic passive forward path P(z) and the electro-acoustic secondary path transfer function S(z), a first least means square filter receiving the error signal e(n), inverted, and filtering to generate a predicted S(z) filter value SE(z), and feeding back filtered error signal e(n) into the first least means square filter in a feedback loop, so that filter value SE(z) is updated over time, a predictive filter using the estimate transfer function SE(z) accepting input x(n) and outputting a predictive value, and a second least means squared filter, receiving the predictive value and outputting a value to generate anti-noise filter transfer function W(z).

16. The system for testing a portable device of claim 15, wherein the region of interest ranges from substantially 100 Hz to substantially 3 kHz.

17. A method for testing a portable device, the portable device including at least a speaker, a reference microphone, an error microphone, and an adaptive noise cancellation circuit, the method comprising:

emulating a predetermined acoustical environment for the portable device in a test stand holding the portable device in a predetermined configuration and;

interfacing the portable device in an interface emulating operation of the adaptive noise cancellation circuit in the portable device, including an anti-noise filter coupled to the audio coder/decoder, generating an anti-noise signal as a predetermined function of the acoustic passive forward path P(z) extending from the reference microphone to the error microphone, to minimize amplitude of ambient acoustic events at the error microphone, the anti-noise filter having a transfer function W(z) and the adaptive noise cancellation circuit estimates the acoustic passive forward path P(z) combined with removing effects of an electro-acoustic secondary path S(z) representing the response of audio output circuits of the audio coder/decoder and an acoustic/electric transfer function of the speaker, including acoustical coupling between the speaker and the error microphone in a predetermined acoustical environment of the portable device;

calculating in a processor coupled to the interface and receive transfer function data for a transfer function W(z) and a transfer function S(z), and adapted to calculate a quality factor for the portable device as a function of the invertability of the transfer function W(z) relative to the transfer function S(z); and displaying on a display, coupled to the processor, for displaying the quality factor for the portable device in the predetermined configuration.

18. The method for testing a portable device of claim 17 wherein the adaptive noise cancellation circuit in the interface includes an adaptive filter receiving a reference microphone signal x(n), and adapting the transfer function of the adaptive filter W(z) to be a ratio of the acoustic passive forward path transfer function P(z) and the electro-acoustic secondary path transfer function S(z) to generate an anti noise signal.

19. The method for testing a portable device of claim 18, wherein a quality factor QF is determined by the invertability of the transfer function W(z) relative to the acoustic passive forward path transfer function S(z) and the method for testing a portable device is optimized for performance for the predetermined acoustical environment by selecting a configuration for the method for testing a portable device having an optimized quality factor QF.

20. The method for testing a portable device of claim 19, wherein the quality factor QF is determined by:

$$QF = 20\log_{10}\left(\frac{\mathrm{rms}(x_{bp}(n))}{\mathrm{rms}(e_{bp}(n))}\right)$$

where x(n) represents a spectrum of a noise signal from the reference microphone, where e(n) represents a spectrum of error signal from the error microphone, where xbp(n) represents the spectrum of noise signal x(n) passed through a bandpass filter to filter out a region of interest, and where ebp(n) represents the spectrum of error signal e(n) passed through a bandpass filter to filter out a region of interest.

21. The method for testing a portable device of claim 20, further comprising:

estimating a transfer function SE(z) of electro acoustic secondary path transfer function S(z) to compensate for delay characteristics of the acoustic passive forward path P(z) and the electro-acoustic secondary path transfer function S(z), filtering in a first least means square filter receiving the error signal e(n), that is inverted, and generating a predicted S(z) filter value SE(z), feeding back a filtered error signal e(n) into the first least means square filter in a feedback loop, so that filter value SE(z) is updated over time, filtering with a predictive filter using the estimate transfer function SE(z) accepting input x(n) and outputting a predictive value, and filtering with a second least means squared filter, receiving the predictive value and outputting a value to generate anti-noise filter transfer function W(z).

22. The method for testing a portable device of claim 21, wherein the region of interest ranges from substantially 100 Hz to substantially 3 kHz.

* * * * *